US012000151B2

(12) United States Patent
Fluty et al.

(10) Patent No.: US 12,000,151 B2
(45) Date of Patent: Jun. 4, 2024

(54) MOVABLE PLATFORM FOR A PATH

(71) Applicant: Universal City Studios LLC, Universal City, CA (US)

(72) Inventors: Daren E. Fluty, Orlando, FL (US); Christine Marie Sorrentino, Orlando, FL (US); Jeff Kelso, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 687 days.

(21) Appl. No.: 17/157,403

(22) Filed: Jan. 25, 2021

(65) Prior Publication Data

US 2021/0301539 A1 Sep. 30, 2021

Related U.S. Application Data

(60) Provisional application No. 63/000,297, filed on Mar. 26, 2020.

(51) Int. Cl.

| | |
|---|---|
| ***E04F 11/00*** | (2006.01) |
| ***A63G 7/00*** | (2006.01) |
| ***E04F 11/18*** | (2006.01) |

(52) U.S. Cl.

CPC ..... *E04F 11/002* (2013.01); *A63G 7/00* (2013.01); *E04F 11/1812* (2013.01); *E04F 2011/007* (2013.01)

(58) Field of Classification Search

CPC ..... E04F 11/002; E04F 11/1812; E04F 2011/007; A63G 7/00

USPC ..... 14/69.5–72.5

See application file for complete search history.

(56) References Cited

U.S. PATENT DOCUMENTS

| | | | | |
|---|---|---|---|---|
| 809,589 | A | 1/1906 | Timmons | |
| 1,756,832 | A * | 4/1930 | Maynes | A63G 1/34 104/173.1 |
| 3,060,471 | A * | 10/1962 | Der Yuen | B64F 1/3055 14/71.5 |
| 4,121,695 | A * | 10/1978 | Carpenter | B60P 1/4421 414/539 |
| 4,176,999 | A * | 12/1979 | Thorley | A61G 3/062 280/166 |
| 6,793,039 | B2 * | 9/2004 | Schmid, Jr. | E06C 1/387 182/84 |
| 6,981,573 | B2 * | 1/2006 | Nickel | E04G 1/38 74/425 |
| 7,237,294 | B2 | 7/2007 | Lensing | |

(Continued)

FOREIGN PATENT DOCUMENTS

| | | | |
|---|---|---|---|
| DE | 202016002976 | U1 | 8/2017 |
| EP | 2484416 | A1 | 8/2012 |

OTHER PUBLICATIONS

PCT/US2021/023489 Invitation to Pay Additional Fees mailed Jun. 25, 2021.

*Primary Examiner* — Raymond W Addie

(74) *Attorney, Agent, or Firm* — Fletcher Yoder, P.C.

(57) ABSTRACT

An amusement park attraction system includes a user path extending through at least a portion of the amusement park attraction system, a railing extending along the user path, and a platform slidingly and rotatably coupled to the railing. The platform is configured to translate along the railing to position the platform relative to the user path, and the platform is configured to rotate relative to the user path to adjust between a stowed configuration and a deployed configuration.

20 Claims, 7 Drawing Sheets

(56) References Cited

U.S. PATENT DOCUMENTS

| | | | | |
|---|---|---|---|---|
| 9,775,326 | B1 * | 10/2017 | MacNeil | A01K 29/00 |
| 2002/0183123 | A1 | 12/2002 | De-Gol | |
| 2005/0150064 | A1 * | 7/2005 | Hill | E01D 15/24 187/245 |
| 2008/0159838 | A1 * | 7/2008 | Sherer | B60P 1/435 414/537 |
| 2010/0290835 | A1 | 11/2010 | David | |
| 2019/0014773 | A1 * | 1/2019 | Lamb | E06C 7/183 |
| 2019/0037799 | A1 * | 2/2019 | Murray | A01K 1/0272 |
| 2019/0150400 | A1 * | 5/2019 | Kumar | B65G 69/30 |

* cited by examiner

MOVABLE PLATFORM FOR A PATH

CROSS REFERENCE TO RELATED APPLICATIONS

This application claims priority from and the benefit of U.S. Provisional Application Ser. No. 63/000,297, entitled "MOVABLE PLATFORM FOR A PATH," filed Mar. 26, 2020, which is hereby incorporated by reference in its entirety for all purposes.

BACKGROUND

This section is intended to introduce the reader to various aspects of art that may be related to various aspects of the present disclosure. This discussion is believed to be helpful in providing the reader with background information to facilitate a better understanding of the various aspects of the present disclosure. Accordingly, it should be noted that these statements are to be read in this light and not as admissions of prior art.

An amusement park includes various features that provide a unique experience for guests of the amusement park. For example, the amusement park may include different attraction systems, such as a roller coaster, a motion simulator, a drop tower, a performance show, a log flume, and so forth. Guests may navigate to any of these attraction systems via a pathway in order to experience the attraction system.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, an amusement park attraction system includes a user path extending through at least a portion of the amusement park attraction system, a railing extending along the user path, and a platform slidingly and rotatably coupled to the railing. The platform is configured to translate along the railing to position the platform relative to the user path, and the platform is configured to rotate relative to the user path to adjust between a stowed configuration and a deployed configuration.

In an embodiment, an auxiliary path system for an amusement park attraction includes a support panel, a platform coupled to the support panel, and a mount configured to couple the support panel to a railing of the amusement park attraction. The mount is configured to translate along the railing to move the support panel and the platform relative to the railing.

In an embodiment, an amusement park attraction system includes a user path extending within the amusement park attraction system, in which the user path comprises a railing, and the amusement park attraction system includes an auxiliary path and/or a bridging system. The auxiliary path and/or the bridging system includes a support panel configured to movably couple to the railing and a platform movably coupled to the support panel. The platform is movable relative to the support panel to transition the auxiliary path and/or the bridging system between a stowed configuration and a deployed configuration. The amusement park attraction system also includes a ride vehicle configured to at least partially extend across the user path, and the auxiliary path and/or the bridging system is configured to be in the deployed configuration when the ride vehicle at least partially extends across the user path such that the platform at least partially extends over the ride vehicle

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
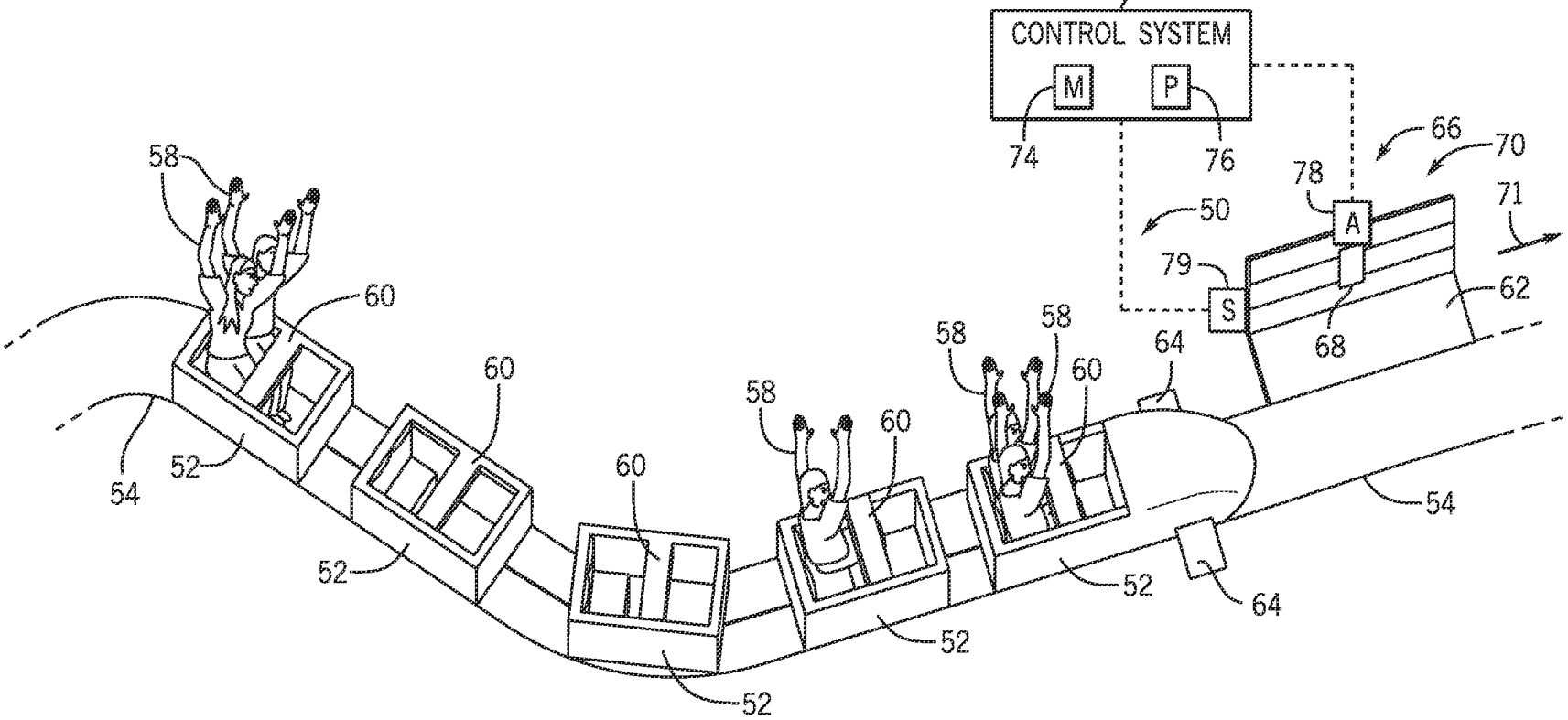
FIG. 1 is a perspective view of an embodiment of an attraction system having a user path and an auxiliary path system, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure relates to a system (e.g., an auxiliary path and/or bridging system) that facilitates navigation of a path (e.g., a user path). In an embodiment, the disclosure may be implemented in an attraction system for an entertainment venue, such as an amusement park. By way of example, the attraction system may include a ride vehicle that may move (e.g., along a track) to entertain an occupant within the ride vehicle. The attraction system may also include a user path that a user, such as a guest of the entertainment venue, an occupant within the ride vehicle, an operator of the attraction system, a technician of the attraction system, or any other suitable user, may use to navigate through the attraction system. For example, the user path may lead to and from an entrance and/or an exit of the attraction system.

In some circumstances, the ride vehicle may be configured to be positioned adjacent to the user path at least during part of a ride cycle or operation. The ride vehicle may also include a feature that may extend across the user path, such as when the ride vehicle is adjacent to the user path. In this way, the feature of the ride vehicle may hinder navigation of the user path. For example, the user may have to step over and/or step around the feature to travel along the user path. In another example, certain items, such as strollers, wheelchairs or carts, may have to be lifted and carried to avoid the feature to travel along the user path. Thus, the position of the feature across the user path may reduce the navigability of the user path.

As such, there is a need for a system that facilitates traversing the feature in order to improve the navigability of the user path. Accordingly, embodiments of the present disclosure are directed to an auxiliary path and/or bridging system that may be movable relative to the user path. In an embodiment, the auxiliary path system may include a platform that may be elevated from the user path. The platform may be movable along the user path so as to move the platform to a desirable position relative to the feature, such as to a position in which the platform extends substantially above the feature, thereby enabling the users to navigate above and traverse the feature. In this manner, the platform may be adjusted based on the position of the feature relative to the user path. Additionally or alternatively, the auxiliary path system may be adjustable between a deployed configuration and a stowed configuration. In the deployed configuration, the platform may extend at least partially across the user path to facilitate traversing the ride vehicle feature. In the stowed configuration, the platform may not extend across the user path in order to reduce the space (e.g., a physical footprint) occupied by the auxiliary path system. For example, the auxiliary path system may be in the stowed configuration to avoid blocking navigation of the user path when the ride vehicle feature does not cross the user path. In other words, the auxiliary path system may be in the stowed configuration when the user does not have to traverse the ride vehicle feature. Furthermore, the stowed configuration may enable the platform to be moved more easily relative to the user path. Accordingly, the auxiliary path system may be in the stowed configuration to facilitate moving the platform to a desirable position before transitioning the auxiliary path system into the deployed configuration to enable the platform to facilitate traversal of the ride vehicle feature.

With the preceding in mind, FIG. 1 is a perspective view of an embodiment of an attraction system 50. In the illustrated embodiment, the attraction system 50 includes multiple ride vehicles 52 coupled together (e.g., via a link) and configured to travel along a ride path 54. The ride path 54 may be a track that guides the movement (e.g., direction, speed, and/or orientation) of the ride vehicles 52 through the attraction system 50. In an additional or alternative embodiment, the ride path 54 may generally include a surface along which each ride vehicle 52 may navigate (e.g., manually by the guests 58) without guiding the path of travel of the ride vehicles 52. In a further embodiment, the attraction system 50 may not have a ride path 54, and the ride vehicles 52 (e.g., a motion simulator) may not substantially move between locations within the attraction system 50. Each ride vehicle 52 also may hold one or more guests 58 of the attraction system 50. As an example, each ride vehicle 52 may include a restraint 60, such as a lap bar, configured to secure the guest 58 within the ride vehicle 52 during operation of the attraction system 50 (e.g., as the ride vehicles 52 move along the ride path 54).

The illustrated attraction system 50 also includes a user path 62, which may be a platform or other pathway that enables the guests 58 to navigate through the attraction system 50 outside of the ride vehicles 52, such as from an entrance of the attraction system 50 and/or to an exit of the attraction system 50. As an example, the user path 62 may be a part of a loading station (e.g., a starting section of the ride path 54) where the guests 58 may enter the ride vehicles 52 and/or the user path 62 may be a part of an unloading station (e.g., an end section of the ride path 54) where the guests 58 may exit from the ride vehicles 52. As another example, the user path 62 may be a part of a different section (e.g., at an intermediate section of the ride path 54) of the attraction system 50 where the guests 58, an operator, a technician, or any other user of the attraction system 50 may navigate outside of the loading station or unloading station.

In an embodiment, at least one of the ride vehicles 52 may include one or more features 64 that extend from the ride vehicle 52. For example, the features 64 may be a structural design (e.g., a prop, an attachment, an extension) of the ride vehicle 52 implemented to provide greater entertainment to the guests 58. During operation of the attraction system 50, the ride vehicles 52 may be positioned adjacent to the user path 62 such that the features 64 may extend across the user path 62. For instance, the user path 62 may extend near the ride path 54, and the features 64 may block a part of the user path 62 as the ride vehicles 52 travel along the ride path 54. As a result, the features 64 may hinder users from easily navigating the user path 62.

For this reason, the user path 62 may include an auxiliary path and/or bridging system 66 that helps users traverse the features 64 to navigate the user path 62. For example, the auxiliary path system 66 may include a platform 68 that helps the users cross over the features 64. The platform 68 may be adjustably (e.g., slidingly) positioned relative to the user path 62. In one embodiment, the platform 68 may be adjustably coupled to railings 70 extending along the user path 62. In an additional or alternative embodiment, the platform 68 may be adjustably coupled to another part (e.g., a floor) of the user path 62. In any case, the platform 68 may translate relative to the user path 62 along a lateral axis 71 to adjust the positioning of the platform 68 relative to the user path 62. As such, the platform 68 may be moved to substantially align (e.g., relative to the lateral axis 71) with the features 64, thereby enabling the platform 68 to facilitate navigating the user path 62 more easily based on the position of the features 64 relative to the user path 62.

Furthermore, the auxiliary path system 66 may also be adjustable between a stowed configuration and a deployed configuration. In the illustrated embodiment, the auxiliary path system 66 is in the stowed configuration in which the platform 68 may not extend across the user path 62. As an example, the platform 68 may be folded proximate to the railings 70. Thus, the stowed configuration of the auxiliary path system 66 may enable the platform 68 to be moved more easily (e.g., translated along the lateral axis 71) relative to the user path 62 and/or to facilitate improved navigation of the user path 62 when the features 64 do not extend across the user path 62. In the deployed configuration of the auxiliary path system 66, the platform 68 may extend across the user path 62 to enable the users to traverse the features 64 more easily. Therefore, the auxiliary path system 66 may be transitioned from the stowed configuration to the deployed configuration when the features 64 extend across the user path 62 and when the platform 68 is at a desirable position relative to the features 64 along the lateral axis 71.

In an embodiment, the auxiliary path system 66 may be manually adjustable. For example, a user, such as an operator, technician, or guest, may manually move the platform 68 relative to the user path 62 and/or may manually transition the platform 68 between the stowed configuration and the deployed configuration. In an additional or alternative embodiment, the attraction system 50 may include a control system 72 (e.g., an electric controller) configured to move the auxiliary path system 66. The control system 72 may include a memory 74 and processing circuitry 76, such as a microprocessor. The memory 74 may include volatile memory, such as random access memory (RAM), and/or non-volatile memory, such as read-only memory (ROM), optical drives, hard disc drives, solid-state drives, or any other non-transitory computer-readable medium that includes instructions to operate the attraction system 50, such as to move the auxiliary path system 66. The processing circuitry 76 may include one or more application specific integrated circuits (ASICs), one or more field programmable gate arrays (FPGAs), one or more general purpose processors, or any combination thereof, configured to execute the instructions stored in the memory 74 to control the attraction system 50. Such instructions may enable the processing circuitry 76 to move the platform 68 relative to the user path 62. For instance, the platform 68 may include an actuator 78, and the control system 72 may output a control signal to instruct the actuator 78 to move the platform 68 relative to the user path 62 to align with the features 64 and/or to transition between the stowed configuration and the deployed configuration of the auxiliary path system 66.

In one embodiment, the control system 72 may be configured to receive a user input to operate the attraction system 50. For instance, the control system 72 may include a user interface with which a user, such as an operator and/or a guest of the attraction system 50, may interact to operate the attraction system 50. In an additional or alternative embodiment, the control system 72 may automatically operate the attraction system 50 without receiving the user input. To this end, the attraction system 50 may include a sensor 79 configured to monitor an operating parameter of the attraction system 50. By way of example, the sensor 79 may be configured to monitor a position of the features 64 relative to the user path 62, a position of the ride vehicles 52 along the ride path 54 and/or relative to the user path 62, a position of the platform 68 relative to the user path 62, a time of operation of the attraction system 50 that may be indicative of the position of the features 64 relative to the user path 62, another suitable operating parameter, or any combination thereof. The sensor 79 may transmit data indicative of the operating parameter to the attraction system 50, and the control system 72 may cause the actuator 78 to move the platform 68 based on the data (e.g., to align with the features 64 and/or to enter the deployed configuration) to facilitate navigation of the user path 62. By way of example, the control system 72 may instruct the actuator 78 to move the platform 68 to transition the auxiliary path system 66 to the deployed configuration in response to receiving sensor data indicative that the feature 64 of one of the ride vehicles 52 at least partially extends across the user path 62.

Figure 2:
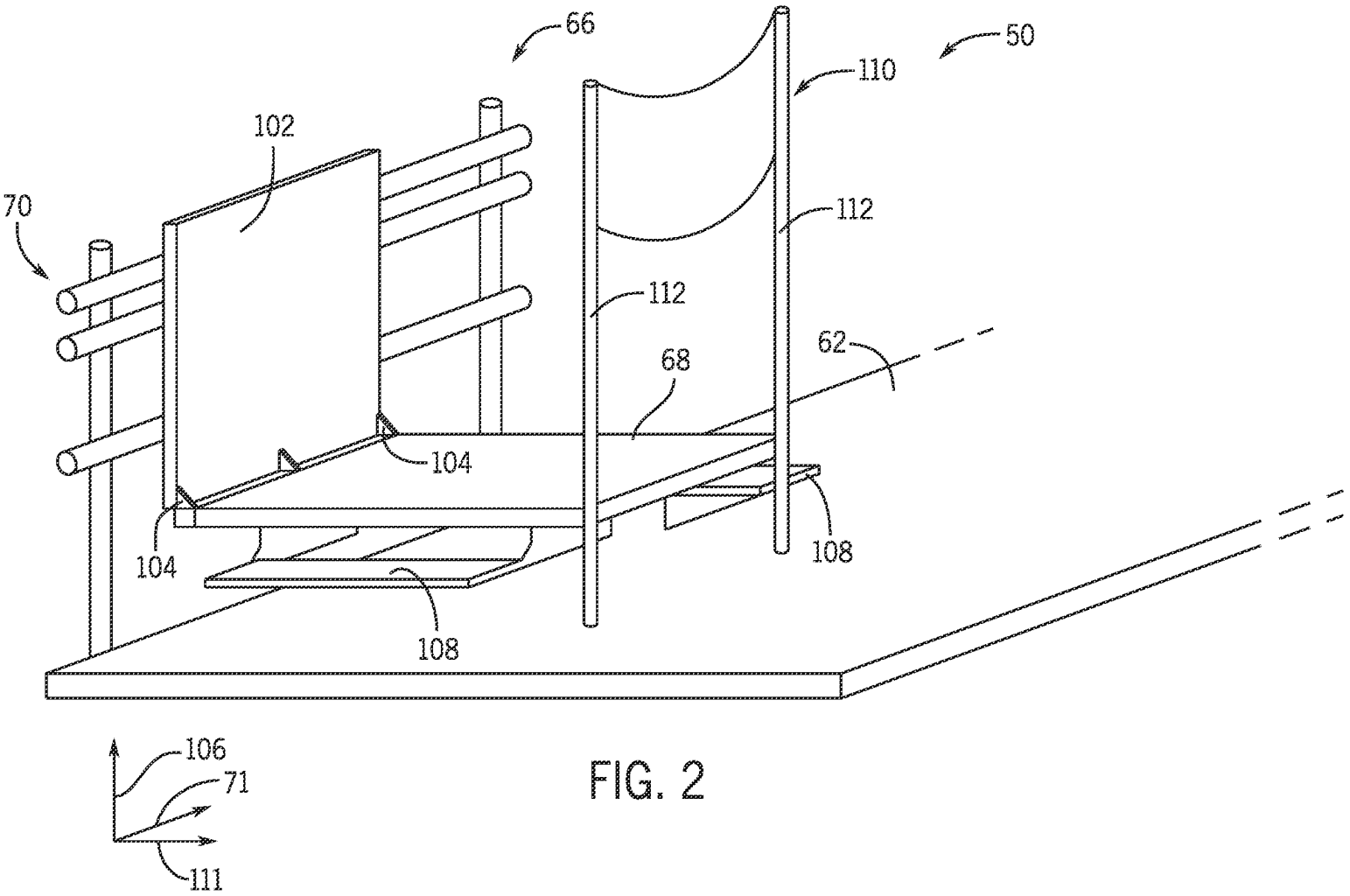
FIG. 2 is a perspective view of an embodiment of a portion of an attraction system having an auxiliary path system in a deployed configuration, in accordance with an aspect of the present disclosure.

FIG. 2 is a perspective view of a portion of an embodiment of the attraction system 50 in which the auxiliary path system 66 is in the deployed configuration such that the platform 68 extends at least partially across the user path 62. The auxiliary path system 66 may also include a support panel 102 configured to movably couple to the railings 70 of the user path 62 such that the support panel 102 may move along the railings 70, thereby moving the platform 68 relative to the railings 70 and relative to the user path 62. It should be noted that the support panel 102 may have any suitable structure to couple to the railings 70 and to the platform 68. Although the illustrated embodiment includes three railings 70, an additional or alternative embodiment may include any suitable number of railings 70, such as one railing, two railings, or four or more railings 70. At least one of the railings 70 may be coupled to the support panel 102 in order to support the auxiliary path system 66. The platform 68 may be movable relative to the support panel 102 so as to transition between the stowed configuration and the deployed configuration. To this end, the auxiliary path system 66 may include hinges 104 that rotatably couple the platform 68 and the support panel 102 together. Thus, the platform 68 may rotate (e.g., fold and unfold) relative to the support panel 102. For example, in the illustrated deployed configuration, the platform 68 is oriented to be substantially perpendicular to the support panel 102. As a result, the platform 68 may extend above the user path 62 relative to a vertical axis 106 and may be generally parallel relative to the user path 62 to facilitate navigation of the user path 62. In an additional or alternative embodiment, the platform 68 may move relative to the support panel 102 in any other suitable manner. As an example, the platform 68 may translate in a linear direction and/or may move in a telescoping manner relative to the support panel 102. In any case, the platform 68 may be movable relative to the support panel 102 in order to transition the auxiliary path system 66 between the deployed configuration and the stowed configuration.

The auxiliary path system 66 may also include steps 108 that are coupled to the platform 68. The steps 108 may enable users to transition from the user path 62 to the platform 68. To this end, the steps 108 may be positioned between the user path 62 and the platform 68 relative to the vertical axis 106 in the deployed configuration of the auxiliary path system 66. Although the illustrated auxiliary path system 66 includes two steps 108 (e.g., one step 108 positioned on opposite sides of the platform 68), an additional or alternative auxiliary path system 66 may include any suitable number of steps 108, such as multiple steps 108 on opposite sides of the platform 68. The auxiliary path system 66 may have the same number of steps on opposite sides of the platform 68 or a different number of steps on opposite sides of the platform 68 to enable the users to traverse the features 64 of the ride vehicles 52 of FIG. 1. In an embodiment, the steps 108 may be movably coupled relative to the platform 68. For instance, the steps 108 may be configured to rotate and/or translate relative to the platform 68 to move between a retracted configuration and an extended configuration. As an example, the steps 108 may be in the extended configuration while the auxiliary path system 66 is in the deployed configuration to facilitate navigation of the user path 62, and the steps 108 may be in the retracted configuration while the auxiliary path system 66 is in the stowed configuration to make the auxiliary path system 66 more compact and/or to facilitate adjustment of the auxiliary path system 66 along the lateral axis 71.

Furthermore, the illustrated auxiliary path system 66 includes a support barrier 110 positioned offset from the support panel 102 along a longitudinal axis 111. The support barrier 110 may facilitate navigation of the auxiliary path system 66 by partially enclosing the platform 68 (e.g., with the support panel 102 and the railings 70) to maintain the users on the platform 68. For example, users may grip the support barrier 110 while navigating the platform 68 for greater support. In one embodiment, the support barrier 110 may be configured to removably couple to the platform 68. For instance, the platform 68 may include slots or openings (e.g., through holes, openings, grooves) through which extensions 112 (e.g., legs) of the support barrier 110 may be inserted when the auxiliary path system 66 is in the deployed configuration. The slots may block movement of the support barrier 110 relative to the platform 68, thereby enabling the support barrier 110 to provide support for navigating the platform 68. In order to transition the auxiliary path system 66 from the deployed configuration to the stowed configuration, the support barrier 110 may be removed from the slots, thereby enabling the platform 68 to rotate toward the support panel 102. In an additional or alternative embodiment, the user path 62 may include similar slots or openings through which the extensions 112 may be inserted to position the support barrier 110 adjacent to platform 68 and provide support to navigate the platform 68. In a further embodiment, the support barrier 110 may be a part of the auxiliary path system 66. By way of example, the support barrier 110 may be rotatably and/or translatably coupled to the platform 68. Thus, the support barrier 110 may be configured to rotate and/or translate relative to the platform 68, such as to move between a retracted configuration and an extended configuration based on the configuration of the auxiliary path system 66. In any case, the support barrier 110 may be implemented when the auxiliary path system 66 is in the deployed configuration, and the support barrier 110 may be withdrawn when the auxiliary path system 66 is in the stowed configuration.

Figure 3:
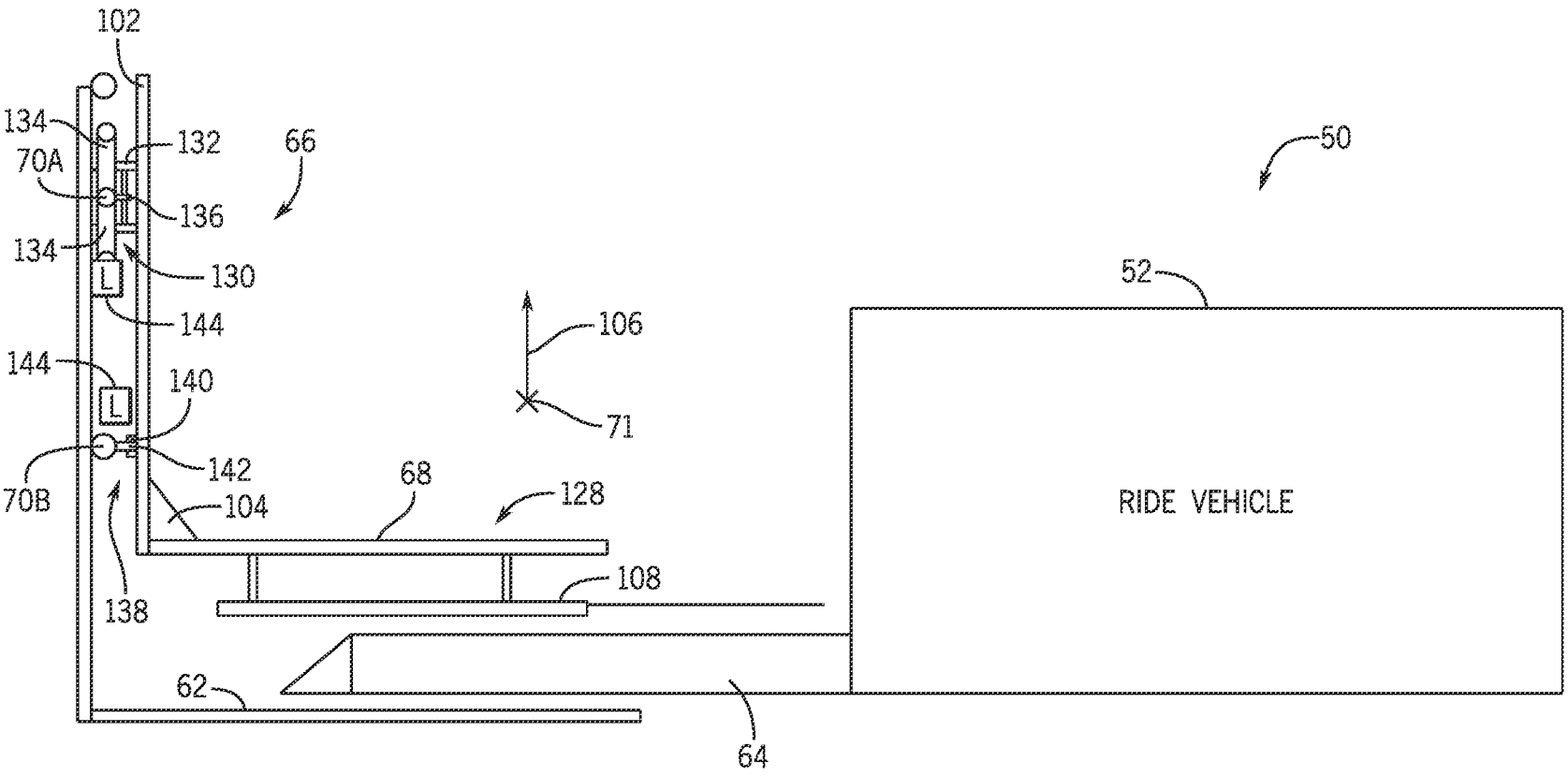
FIG. 3 is a side view of an embodiment of a portion of an attraction system having an auxiliary path system in a deployed configuration, in accordance with an aspect of the present disclosure.

FIG. 3 is a side view of an embodiment of a portion of the attraction system 50 in which the auxiliary path system 66 is in the deployed configuration. As illustrated in FIG. 3, in the deployed configuration, the steps 108 and/or the platform 68 may be positioned over the features 64 of the ride vehicle 52 along the vertical axis 106 (e.g., the vertical axis 106 extending through the feature 64) such that users may utilize the auxiliary path system 66 to traverse the features 64 more easily. In particular, the features 64 may be positioned with a gap between the user path 62 and the platform 68 along the vertical axis 106 such that the users may utilize the auxiliary path system 66 to step over the features 64 while the features 64 cross the user path 62. In the deployed configuration, a surface 128 of the platform 68 (e.g., that the user steps on) may generally face vertically upward.

The illustrated support panel 102 may be coupled to a first railing 70A via a first mount 130 of the support panel 102. The first mount 130 may include a base 132 coupled (e.g., fixedly coupled) to the support panel 102. The first mount 130 may also include wheels 134 rotatably coupled to the base 132. The wheels 134 may engage the first railing 70A and may rotate in order to drive the first mount 130 and the support panel 102 to move relative to the first railing 70A along the lateral axis 71, thereby moving the auxiliary path system 66 relative to the user path 62. For example, each of the wheels 134 may include a groove formed such that the wheels 134 may capture the geometry of the first railing 70A, thereby blocking unwanted movement (e.g., rotational movement about the lateral axis 71) of the first mount 130 and of the support panel 102 relative to the first railing 70A. Although the illustrated first mount 130 includes two wheels 134, an additional or alternative first mount 130 may include any number of wheels 134, such as one wheel 134 or three or more wheels 134. Further, the first mount 130 may include a roller 136 rotatably coupled to the base 132. The roller 136 may also engage the first railing 70A and may rotate to enable adjustment of the auxiliary path system 66 relative to the first railing 70A along the lateral axis 71. Furthermore, the roller 136 may be shaped to abut the first railing 70A, thereby providing additional support to block unwanted movement of the first mount 130 relative to the first railing 70A.

The illustrated support panel 102 may additionally or alternatively couple to a second railing 70B via a second mount 138. The second mount 138 may include a base 140 and a roller 142 rotatably coupled to the base 140. The roller 142 may engage the second railing 70B and may rotate to enable the support panel 102 to move relative to the second railing 70B. The illustrated roller 142 is not shaped (e.g., does not have grooves) to capture the geometry of the second railing 70B, but an additional or alternative roller 142 may be implemented to capture the second railing 70B. In a further embodiment, the second mount 138 may include a different number of rollers 142, such as two or more rollers 142 configured to engage the second railing 70B. In any case, the interface between the second railing 70B and the second mount 138 may block unwanted movement between the support panel 102 relative to the second railing 70B, thereby also blocking unwanted movement between the support panel 102 relative to the first railing 70A.

It should also be noted that the first mount 130 and/or the second mount 138 may include a lock 144 that may be activated in order to maintain a position of the support panel 102 relative to the railings 70 along the lateral axis 71. The lock 144 may include a latch, a clamp, a pushpin, a clip, a stopper, another type of lock (e.g., a mechanical lock, an electronically controlled magnetic lock), or any combination thereof. The lock 144, for instance, may block the wheels 134, the roller 136, and/or the roller 142 from rotating, thereby blocking movement of the support panel 102 along the railings 70. In one embodiment, the lock 144 may be manually adjustable by a user in order to enable or block movement of the support panel 102 relative to the railings 70. In an additional or alternative embodiment, the lock 144 may be automatically adjusted. For instance, the control system 72 of FIG. 1 may be communicatively coupled to an actuator of the lock 144 and may output a control signal to cause the actuator to adjust the lock 144, such as based on data transmitted by a sensor (e.g., the sensor 79 of FIG. 1) and indicative of the platform 68 being at a desirable position relative to the user path 62, the features 64, the railings 70, or any combination thereof.

Although the illustrated auxiliary path system 66 includes mounts 130, 138 having wheels 134, the roller 136, and the roller 142, respectively, an additional or alternative auxiliary path system 66 may have mounts 130, 138 that may enable movement along the railings 70 in another manner. For instance, the mounts 130, 138 may have a guide (e.g., a sleeve, a tube) that capture the railings 70, the railings 70 may have a slot through which the mounts 130, 138 may extend and move along, and/or the interface between the mounts 130, 138 may include any other suitable structure to enable movement of the support panel 102 relative to the railings 70 along the lateral axis 71.

Figure 4:
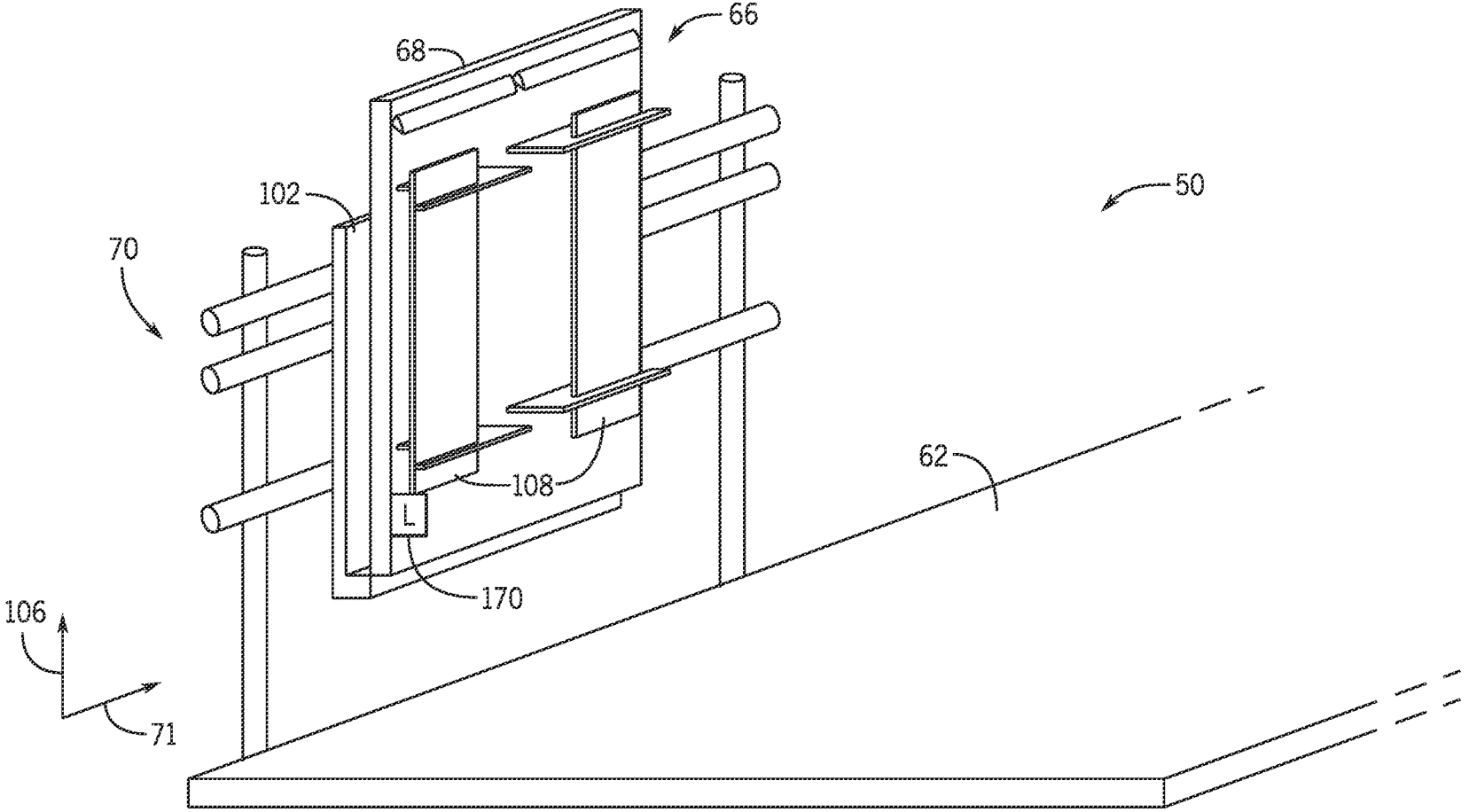
FIG. 4 is a perspective view of an embodiment of a portion of an attraction system having an auxiliary path system in a stowed configuration, in accordance with an aspect of the present disclosure.

FIG. 4 is a perspective view of an embodiment of a portion of the attraction system 50 in which the auxiliary path system 66 is in the stowed configuration. By way of example, the auxiliary path system 66 may be transitioned to the stowed configuration when the features of the ride vehicles do not cross the user path 62 and/or when users do not wish to travel over the features. In order to transition the auxiliary path system 66 into the stowed configuration, the platform 68 may be rotated toward (e.g., folded) the support panel 102 such that the platform 68 may extend along and/or abut the support panel 102, thereby generally aligning with the support panel 102 (e.g., the surface 128 of FIG. 3 on which the users walk is substantially parallel to the vertical axis 106 and/or faces toward or abuts the support panel 102 and/or the railings 70). As a result, the platform 68 may not extend across or block the user path 62. Moreover, the steps 108 may be moved relative to the platform 68 such that the steps 108 substantially overlap with the platform 68 along the lateral axis 71, rather than extend away from platform 68. In this manner, the auxiliary path system 66 may occupy a smaller physical footprint in the stowed configuration than in the deployed configuration. Accordingly, the auxiliary path system 66 may be moved more easily relative to the railings 70 and/or may facilitate easier navigation along the user path 62 when the features of the ride vehicles do not cross the user path 62.

The auxiliary path system 66 may also include a lock 170 that may be used to maintain the auxiliary path system 66 in the stowed configuration and/or the deployed configuration. In an example, the lock 170 may block movement of the platform 68 relative to the support panel 102 and/or the lock 170 may block movement of the steps 108 relative to the platform 68. The lock 170 may be manually and/or automatically adjustable. In any case, the lock 170 may be disengaged to enable the auxiliary path system 66 to transition between the stowed configuration and the deployed configuration and/or engaged to maintain the auxiliary path system 66 in the stowed configuration and/or the deployed configuration.

Figure 5:
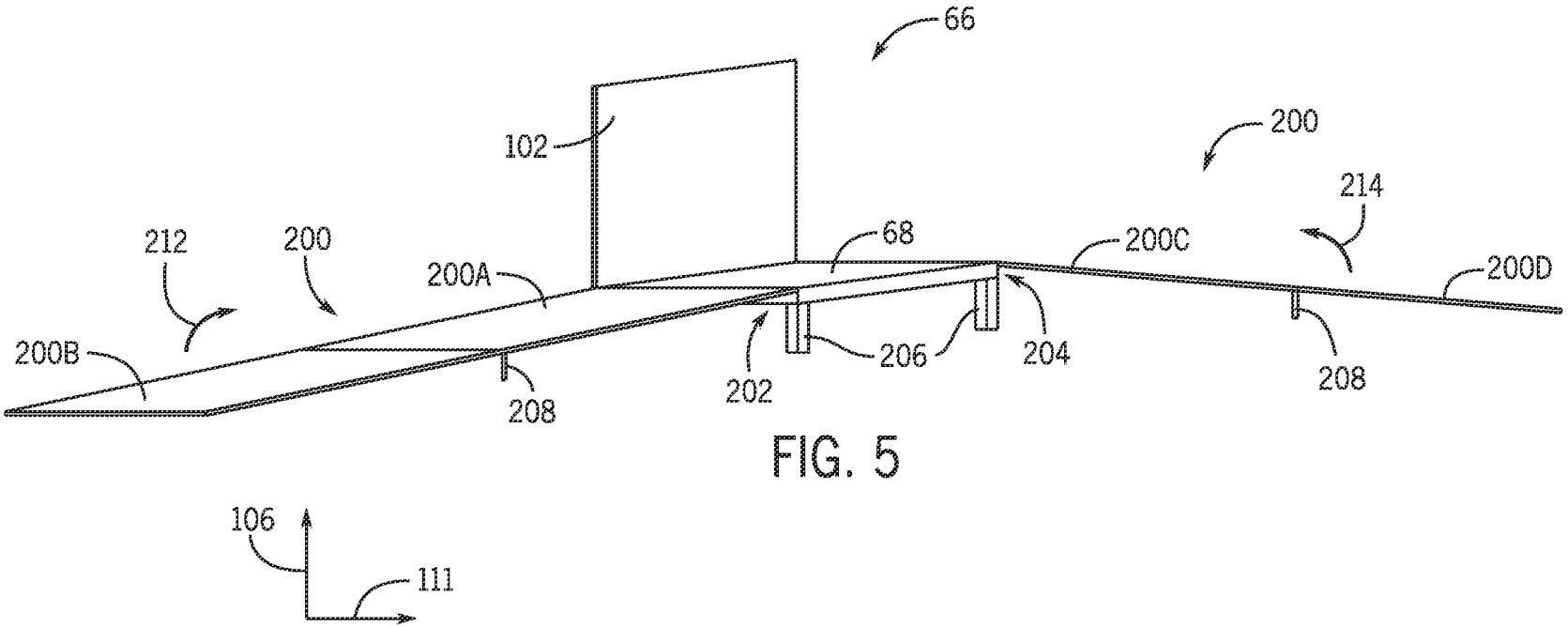
FIG. 5 is a perspective view of an embodiment of an auxiliary path system having ramps in a deployed configuration, in accordance with an aspect of the present disclosure.

FIG. 5 is a perspective view of an embodiment of the auxiliary path system 66 having ramps 200 in the deployed configuration. The illustrated auxiliary path system 66 includes the ramps 200 instead of steps extending from the platform 68 to facilitate navigation. The ramps 200 may generally slope from the platform 68 to the user path. For this reason, the ramps 200 may enable certain items, such as strollers and carts, to be moved over the features of the ride vehicle without having to be lifted to clear the features. In the illustrated embodiment, the ramps 200 extend off opposite sides of the platform 68. For example, a first ramp 200A may extend off a first side 202 of the platform 68, and a second ramp 200B may extend off the first ramp 200A. In the deployed configuration, the second ramp 200B may abut the user path such that the ramp 200 extends from the user path to the platform 68. Furthermore, a third ramp 200C may extend off a second side 204, opposite the first side 202, of the platform 68, and a fourth ramp 200D may extend off the third ramp 200C and may abut the user path in the deployed configuration of the auxiliary path system 66. In an embodiment, the ramps 200 may extend off the platform 68 in a symmetrical manner. To this end, the first ramp 200A may have a similar geometry (e.g., a similar length, a similar width) with respect to the third ramp 200C, and/or the second ramp 200B may have a similar geometry with respect to the fourth ramp 200D. In an additional or alternative embodiment, the ramps 200 may extend off the platform 68 in an asymmetric manner. For instance, each of the ramps 200 may have a different geometry, and/or there may be a different number of ramps 200 extending off the opposite sides 202, 204 of the platform 68. Moreover, although the illustrated auxiliary path system 66 includes four ramps 200, an additional or alternative auxiliary path system 66 may include any suitable number of ramps 200. By way of example, the number of ramps 200 may be based on a height of the platform 68 relative to the user path in order to provide a suitable slope extending from the user path to the platform 68 to facilitate navigation of the auxiliary path system 66.

The illustrated platform 68 further includes supports 206, which may extend away from the platform 68 to abut the user path in the deployed configuration of the auxiliary path system 66. The supports 206 may assist with elevating the platform 68 above the user path along the vertical axis 106, thereby reducing a force exerted onto the interface between the support panel 102 and the railings (e.g., the first mount 130 and/or the second mount 138 of FIG. 3 coupled to the support panel 102). The ramps 200 may include supports 208 that abut the user path in the deployed configuration of the auxiliary path system 66. The supports 208 may facilitate elevating the ramps 200 off the user path, thereby blocking unwanted movement (e.g., deflection) of the ramps 200. In the illustrated auxiliary path system 66, the first ramp 200A and the third ramp 200C each include a respective support 208, but an additional or alternative auxiliary path system 66 may include any suitable number of supports 208. For instance, the second ramp 200B and/or the fourth ramp 200D may each include another support 208, each individual ramp 200 may include multiple supports 208, or the ramps 200 may include any suitable number of supports 208 to elevate and support the ramps 200.

In one embodiment, the ramps 200 may be movable relative to one another in order to transition the auxiliary path system 66 between the stowed configuration and the deployed configuration. As an example, the second ramp 200B may be hingedly coupled to the first ramp 200A, and/or the fourth ramp 200D may be hingedly coupled to the third ramp 200C. Thus, the second ramp 200B may rotate relative to the first ramp 200A, and/or the fourth ramp 200D may rotate relative to the third ramp 200C, such as for transitioning the auxiliary path system 66 between the deployed configuration and the stowed configuration. For instance, in order to transition the auxiliary path system 66 from the deployed configuration toward the stowed configuration, the second ramp 200B may be rotated about a longitudinal axis 111 in a first direction 212 relative to the first ramp 200A, and/or the fourth ramp 200D may be rotated about the longitudinal axis 111 in a second direction 214 relative to the third ramp 200C. In one embodiment, the supports 206, 208 may also be adjustable (e.g., telescoping, rotatable) in order to transition the auxiliary path system 66 from the deployed configuration toward the stowed configuration. In any case, transitioning the auxiliary path system 66 toward the stowed configuration may reduce a physical footprint occupied by the auxiliary path system 66.

Figure 6:
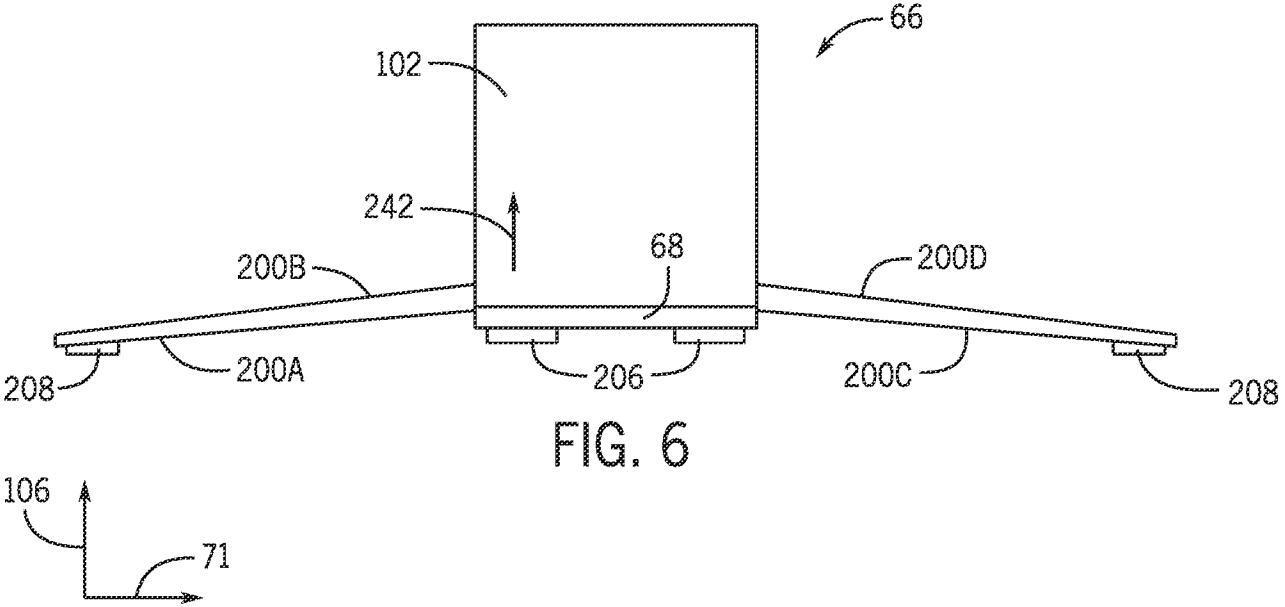
FIG. 6 is a front view of an embodiment of an auxiliary path system having ramps in a partially stowed configuration, in accordance with an aspect of the present disclosure.

FIG. 6 is a front view of an embodiment of the auxiliary path system 66 having the ramps 200 in a partially stowed configuration. In particular, the illustrated partially stowed configuration includes the second ramp 200B rotated to abut the first ramp 200A and the fourth ramp 200D rotated to abut the third ramp 200C. As such, the ramps 200 may not abut the user path. Moreover, the supports 208 are rotated to abut and/or extend along the first ramp 200A and the third ramp 200C, respectively, rather than to extend to abut the user path, and the supports 206 are rotated to abut and/or extend along the platform 68 rather than to extend away from the platform 68 to abut the user path. In this way, the auxiliary path system 66 may occupy a substantially reduced physical footprint in the partially stowed configuration relative to the physical footprint occupied in the deployed configuration.

In one embodiment, the platform 68 may be configured to rotate about the lateral axis 71. For instance, the platform 68 may be rotated in a direction 242 to abut the support panel 102 such that the platform 68 does not extend across the user path. Such adjustment may further reduce the physical footprint occupied by the auxiliary path system 66, thereby transitioning the auxiliary path system 66 from the partially stowed configuration to a fully stowed configuration.

Figure 7:
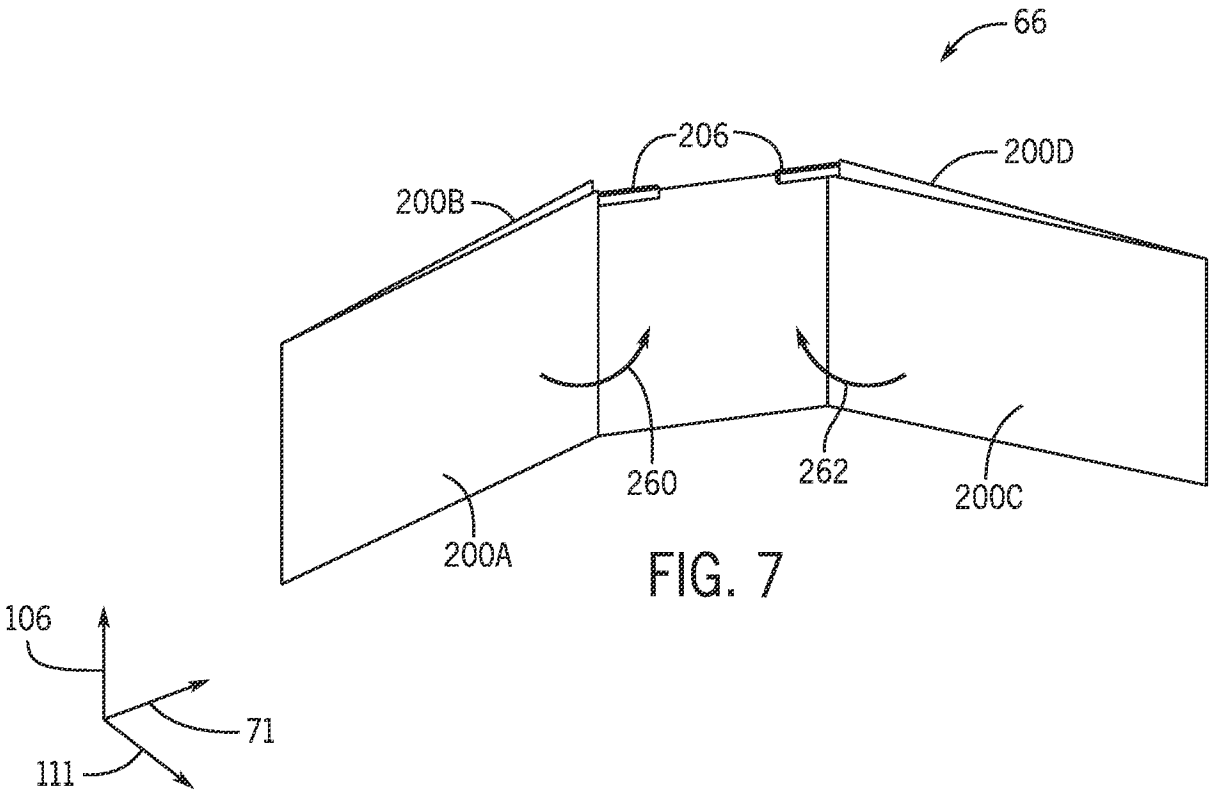
FIG. 7 is a perspective view of an embodiment of an auxiliary path system having ramps in a stowed configuration, in accordance with an aspect of the present disclosure.

FIG. 7 is a perspective view of an embodiment of the auxiliary path system 66 having the ramps 200 in the stowed configuration in which the ramps 200 are rotated to abut one another and the platform 68 is rotated to abut the support panel. In this way, the auxiliary path system 66 may generally extend along the lateral axis 71, rather than along the longitudinal axis 111, such that the auxiliary path system 66 does not substantially extend across the user path. As such, the auxiliary path system 66 may facilitate navigation of the user path when the features of the ride vehicle do not cross the user path.

In an additional or alternative embodiment, the first ramp 200A and/or the third ramp 200C may be rotatably coupled to the platform 68. For example, the first ramp 200A may be rotated in a direction 260 about the vertical axis 106, and/or the third ramp 200C may be rotated in a direction 262 about the vertical axis 106. Such rotation may further reduce the physical footprint occupied by the auxiliary path system 66. By way of example, the first ramp 200A may be rotated to overlap with the platform 68 and/or with the third ramp 200C, and/or the third ramp 200C may be rotated to overlap with the platform 68 and/or with the first ramp 200A. Accordingly, in the stowed configuration, the platform 68, the support panel, and/or the ramps 200 may be stacked atop of one another along a direction traversing a plane formed by the vertical axis 106 and the lateral axis 71. The ramps 200 may have any suitable size (e.g., smaller than the platform 68) to facilitate rotation and folding to the stowed configuration.

Although FIGS. 5-7 illustrate the ramps 200 as rotating relative to one another, the ramps 200 may be additionally or alternatively be moved in any other suitable manner to transition between the stowed configuration and the deployed configuration. By way of example, the ramps 200 may linearly translate relative to one another and/or relative to the platform 68, and/or the ramps 200 may move in a telescoping manner relative to one another and/or relative to the platform 68. Indeed, the ramps 200 may move in any suitable manner to change the physical footprint occupied by the auxiliary path system 66 and/or to adjust the extension of the auxiliary path system 66 across the user path.

While only certain features of the disclosure have been illustrated and described herein, many modifications and changes will occur to those skilled in the art. It is, therefore, to be understood that the appended claims are intended to cover all such modifications and changes as fall within the true spirit of the disclosure. Further, features of FIGS. 1-7 may be combined. For example, the auxiliary path system 66 of FIGS. 5-7 may include components described with reference to FIGS. 3 and 4 to translate along the lateral axis 71 and/or to lock the auxiliary path system 66. In addition, the features described herein may be used in any suitable context or environment.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An amusement park attraction system, comprising:

a user path extending through at least a portion of the amusement park attraction system;

a railing extending along the user path; and a platform slidingly and rotatably coupled to the railing, wherein the platform is configured to translate along the railing to position the platform relative to the user path, and the platform is configured to rotate relative to the user path to adjust between a stowed configuration and a deployed configuration.

2. The amusement park attraction system of claim 1, comprising a ride vehicle comprising a feature that is configured to extend over the user path while the ride vehicle is positioned adjacent to the user path, wherein the platform is configured to translate along the railing to align the platform with the feature and to rotate relative to the user path to enter the deployed configuration to position the platform over the feature along a vertical axis through the feature and thereby facilitate traversal over the feature while the feature extends over the user path.

3. The amusement park attraction system of claim 1, wherein a surface of the platform is configured to face toward the railing in the stowed configuration and is configured to face vertically upward in the deployed configuration.

4. The amusement park attraction system of claim 1, wherein the platform is slidingly and rotatably coupled to the railing via a support panel.

5. The amusement park attraction system of claim 4, wherein the support panel comprises a mount, the mount is slidingly engaged with the railing and configured to translate relative to the railing to translate the support panel and the platform along the railing.

6. The amusement park attraction system of claim 1, comprising a step coupled to the platform.

7. The amusement park attraction system of claim 6, wherein the step is configured to translate, rotate, or both, relative to the platform.

8. The amusement park attraction system of claim 1, comprising a ramp coupled to the platform.

9. The amusement park attraction system of claim 8, wherein the ramp is configured to translate, rotate, or both, relative to the platform.

10. An auxiliary path system for an amusement park attraction, the auxiliary path system comprising:

a support panel;

a platform coupled to the support panel; and a mount configured to couple the support panel to a railing of the amusement park attraction, wherein the mount is configured to translate along the railing to move the support panel and the platform relative to the railing, and the auxiliary path system is configured to provide a gap between the platform and a user path to provide an auxiliary path over a feature that blocks the user path.

11. The auxiliary path system of claim 10, comprising a lock, wherein the mount comprises a base fixedly coupled to the support panel and a wheel rotatably coupled to the base, the wheel is configured to engage the railing, rotation of the wheel drives the base and the support panel to move along the railing, and the lock is configured to block rotation of the wheel to maintain a position of the base and the support panel relative to the railing.

12. The auxiliary path system of claim 10, comprising a control system configured to:

determine a location of the feature relative to the user path;

output a control signal to the mount to translate the mount along the railing to move the support panel and the platform relative to the railing to position the platform proximate to the feature based on the location of the feature relative to the user path; and output an additional control signal to an actuator to adjust the platform relative to the support panel to provide the gap between the platform and the user path to provide the auxiliary path over the feature that blocks the user path.

13. The auxiliary path system of claim 10, comprising one or more actuators configured to move the platform to cause the platform to extend over the feature to position the feature within the gap between the platform and the user path to provide the auxiliary path for a user to travel over the feature that blocks the user path.

14. The auxiliary path system of claim 10, comprising a ramp, a step, or both, movably coupled to the platform.

15. The auxiliary path system of claim 10, wherein the platform is rotatably coupled to the support panel, and the platform is configured to rotate relative to the support panel to adjust between a stowed configuration in which a surface of the platform faces toward the support panel and a deployed configuration in which the surface of the platform faces vertically upward to facilitate traversal across the surface of the platform.

16. An amusement park attraction system, comprising:

a user path extending within the amusement park attraction system, wherein the user path comprises a railing;

an auxiliary path and/or a bridging system, comprising:

a support panel configured to movably couple to the railing; and a platform movably coupled to the support panel, wherein the platform is movable relative to the support panel to transition the auxiliary path and/or the bridging system between a stowed configuration and a deployed configuration; and a ride vehicle configured to at least partially extend across the user path, wherein the auxiliary path and/or the bridging system is configured to be in the deployed configuration when the ride vehicle at least partially extends across the user path such that the platform at least partially extends over the ride vehicle.

17. The amusement park attraction system of claim 16, wherein the platform is configured to abut the support panel in the stowed configuration of the auxiliary path and/or the bridging system and to extend across the user path in the deployed configuration of the auxiliary path and/or the bridging system.

18. The amusement park attraction system of claim 16, comprising a ramp, a step, or both, coupled to the platform, wherein the ramp, the step, or both, are configured to extend away from the platform in the deployed configuration of the auxiliary path and/or the bridging system, and wherein the ramp, the step, or both, are configured to overlap with the platform in the stowed configuration of the auxiliary path and/or the bridging system.

19. The amusement park attraction system of claim 16, comprising an actuator and a control system communicatively coupled to the actuator, wherein the actuator is configured to move the platform relative to the support panel, and wherein the control system is configured to output a control signal to cause the actuator to move the platform relative to the support panel to transition the auxiliary path and/or the bridging system between the stowed configuration and the deployed configuration.

20. The amusement park attraction system of claim 19, wherein the control system is configured to:

determine a location of the ride vehicle relative to the user path; and output the control signal to transition the auxiliary path and/or the bridging system to the deployed configuration in response to determining that the ride vehicle at least partially extends across the user path.

* * * * *